United States Patent [19]

Krafft et al.

[11] 4,056,397

[45] Nov. 1, 1977

[54] DYE DIFFUSION TRANSFER MATERIAL WITH GRAFT POLYMER BINDING LAYER

[75] Inventors: Werner Krafft; Erich Wolff; Wulf von Bonin, all of Leverkusen, Germany

[73] Assignee: AGFA-Gevaert, A.G., Leverkusen, Germany

[21] Appl. No.: 629,104

[22] Filed: Nov. 5, 1975

[30] Foreign Application Priority Data

Nov. 9, 1974 Germany ..... 2453208

[51] Int. Cl.[2] ..... G03C 1/40; G03C 1/48; G03C 1/90

[52] U.S. Cl. ..... 96/77; 96/76 C; 96/83

[58] Field of Search ..... 96/77, 76 C, 83, 71

[56] References Cited

U.S. PATENT DOCUMENTS

| | | | |
|---|---|---|---|
| 3,053,659 | 9/1962 | Land | 96/76 C |
| 3,652,281 | 3/1972 | Bachelder et al. | 96/77 |
| 3,652,282 | 3/1972 | Land | 96/77 |
| 3,730,718 | 5/1973 | Panhauser | 96/77 |
| 3,793,023 | 2/1974 | Land | 96/77 |

*Primary Examiner*—David Klein
*Assistant Examiner*—Richard L. Schilling
*Attorney, Agent, or Firm*—Connolly and Hutz

[57] ABSTRACT

In a photographic monosheet material for the dye diffusion transfer process a temporary bond is adjusted between a first layer and a second layer by placing between said layers another layer of a graft polymer which is obtained by grafting a monomer containing double bonds capable of radical polymerization onto a hydrophilic linear basis polymer. The two layers are firmly bonded to each other but are easily separated, when the processing liquid is forced between them.

3 Claims, No Drawings

DYE DIFFUSION TRANSFER MATERIAL WITH GRAFT POLYMER BINDING LAYER

This invention relates to a photographic monosheet material for the dye diffusion transfer process. The material comprises a plurality of layers, and the bond between a first layer and a second layer is adjusted by using special polymers so that it can be temporarily eliminated.

Monosheet materials for producing coloured transfer images are already known. Between a first and a second dimensionally stable support layer, they contain, as main layer elements, an image receiving layer and a light-sensitive layer unit which comprises at least one light-sensitive silver halide emulsion layer with which a colour producing compound is associated. In addition, a container which can be split open is arranged at the side to hold a liquid for developing the exposed light-sensitive element. When subjected to mechanical forces, this container pours out its contents between two adjacent layer elements of the monosheet material.

The image produced in the image receiving layer is in all cases visible through the first transparent support layer. To show it up clearly from the light-sensitive layer unit in which the developed silver and possibly the residues of dyes are left and in order to obtain an attractive background for the image, a light reflecting layer is provided between the image receiving layer and the light-sensitive layer unit. This reflective layer may be present from the start or it may be produced during development, for example by squeezing a liquid which contains a light-reflecting substance between the light sensitive layer unit and the image receiving layer. The second method is employed if, for example, the second support layer is not transparent. In that case, the finished image must be viewed from the same side from which the light-sensitive layer unit was exposed. The image appears side reversed. To produce images which are the right way round non side reversed, it is necessary to use optical reversing systems (mirrors). These are unnecessary if the transfer image produced in the image receiving layer is viewed from the side opposite to that from which the light-sensitive layer unit was exposed. In that case, however, the second support layer must be transparent and a preformed light-reflecting layer may be provided between the light-sensitive layer unit and the image receiving layer. In monosheet materials, the said layer elements remain in contact even after production of the colour image which is visible through the first transparent support layer. No means are provided for separating the light sensitive layer unit. Means are therefore provided to ensure permanent contact between the layer elements and prevent detachment of individual layers or shifting of the layers out of position from each other. The means provided for this purpose may be, for example, adhesive strips arranged along the edges of the monosheet and gripping both sides of the sheet so as to form an exposure or image frame and prevent the incidence of light from the side.

For processing the monosheet material, the liquid in the container at the side is uniformly distributed between a first and a second layer of this complicated monosheet material. It is in principle immaterial in what position in the structure of the monosheet material these two layers are situated. To ensure correct exposure, firm contact must be established between the corresponding layers at the time of exposure, that is to say before the material is processed. Firm contact between these layers is also desired in the finished image. During processing, however, this contact must be easily eliminated so that the processing liquid can spread out between these layers. The layers are therefore required to have quite special bonding properties. This must be particularly taken into account when selecting the binder for these two layers.

According to one proposal, as described in German Offenlegungsschrift No. 2,261,546, the type of bond required according to the invention, which, in contrast to the permanent bond required between the other layers of the monosheet material, may be referred to as a temporary bond on account of its reversible character, is achieved by means of a bonding agent which comprises a high molecular weight polyethylene glycol which is distributed as a layer between the first and second layer of the monosheet material. The German Offenlegungsschrift referred to a monosheet material in which a first layer element, which comprises as uppermost layer an image receiving layer containing a binder mixture of polyvinyl alcohol and polyvinyl pyridine, is laminated to a second layer element in which the uppermost layer is a gelatine layer. It has been found that the proposed bonding agent is very suitable for this special combination of binder but cannot be applied equally successfully to all other binder compositions. In particular, it cannot ensure the desired temporary bond between two gelatine layers.

It has now been found that bonding agents which have the desired characteristics but differ sharply from each other in their bonding properties are obtained by grafting monomers which have double bonds capable of radical polymerisation on a polyalkylene glycol or a polyalkylene carbonate or a corresponding copolymer. Depending on the proportion of grafted monomer to basic polymer used, it is possible to obtain graft polymers with high to very high solubility in water which have little hydrophilic character and correspondingly modified adhesive properties, which can be optimally adjusted to the chosen binder composition in each case to achieve the desired temporary bond.

This invention therefore relates to a photographic monosheet material for the dye diffusion transfer process, containing the following layers in the given sequence between a first and a second dimensionally stable support layer, at least the first of which two support layers is transparent:

a. an image receiving layer,
b. a light reflecting pigment layer or means for producing such a light reflecting pigment layer and
c. a light sensitive layer unit comprising at least one light-sensitive silver halide emulsion layer which has a colour producing compound associated with it, as well as a destructible container for processing liquid arranged at the side, which when exposed to mechanical forces releases its contents between a first and second layer of the monosheet material, between which two layers a bond exists before and after processing, which bond is temporarily eliminated by the action of the processing liquid, characterised in that between these layers another layer is arranged which mainly comprises a graft polymer obtained from a hydrophilic, linear basic polymer on which a monomer containing double bonds which are capable of radical polymerisation is grafted.

The bonding agents according to the invention thus consist of a graft polymer which is obtained by grafting monomers containing double bonds capable of radical polymerisation on a hydrophilic, linear basic polymer. The basic polymers are mainly polyalkylene glycols, polyalkylene carbonates or copolymers thereof and therefore contain one or more of the following recurrent structural units:

$$-(R_1-O)-,\ -(R_2-O)- \text{ and } -(R_3-O-CO-O)-$$

in which $R_1$, $R_2$ and $R_3$ each represents an alkylene group containing 1 to 8 carbon atoms, e.g. methylene, ethylene, 1,2-propylene, 1,3-propylene, 1,4-butylene and 1,8-octylene.

The following are examples of suitable basic polymers: Polymethylene oxide, polyethylene oxide, polypropylene oxide, polybutylene glycol, polyethylene carbonate and their copolymers, that is to say one and the same polymer chain may contain several different alkylene groups as well as oxygen and carbonate connecting members side by side. Examples of such polymers include diethylene glycol-formaldehyde-polyacetal, copolymers of polypropylene glycol and polybutylene glycol and polycarbonate of polyalkylene glycols such as diethylene, triethylene or tetraethylene glycol. The basic polymers preferably have a molecular weight of between 2000 and 10,000.

The monomers which contain a double bond capable of radical polymerisation, preferably a monoolefinically unsaturated double bond, may be used alone or as monomer mixtures. Such monomers are well known to the expert and include, for example, vinyl compounds such as aromatic vinyl compounds (styrene, vinyltoluene, methylstyrene), vinylethers such as vinyl alkylether (vinylbutylether) or vinyl esters of carboxylic acids which have 2 to 18 carbon atoms (vinyl acetate, vinyl propionate, vinyl stearate, vinyl benzoate, vinyl versate), N-vinyl compounds such as vinyl carbazole, vinylpyrrolidone, vinyl amides, vinyl halides such as vinyl chloride or vinylidene chloride, vinyl ketones, vinyl sulphones, ,β-unsaturated monocarboxylic and polycarboxylic acids (fumaric, maleic, itaconic and (meth)acrylic acid) and their esters of alcohols which contain 1 to 8 carbon atoms, their nitriles, imides, amides, anhydrides, (maleic anhydride, maleic imide, methyl, ethyl and butyl acrylate and methacrylate, (meth)acrylonitrile and (meth)acrylamide) including, for example, their substitution products with reactive groups, e.g. (meth)acrylamidemethylol compounds, esters or amides which contain hydroxyl groups or amino groups, for example of (meth)acrylic acid, olefines such as ethylene, propylene or isobutylene, butenes, allyl compounds such as allyl alcohol, allyl esters (e.g. allyl acetate) and allyl carbonates. Unsaturated compounds containing several double bonds may also be used, such as divinylbenzene, butadiene, isoprene, glycol dimethacrylate, methylene bis-methacrylamide, triallylcyanurate, etc..

Vinyl esters of organic carboxylic acids containing 2 to 18 carbon atoms in the carboxylic acid component are particularly suitable for the preparation of the graft polymers, in particular vinyl acetate, vinyl propionate, vinyl benzoate or vinyl versate, furthermore vinyl halides such as vinyl chloride, vinylidene halides such as vinylidene chloride, (meth)acrylic acid, (meth)acrylonitrile, (meth)acrylic acid amide, (meth)acrylic acid esters with 1 to 8 carbon atoms in the alcohol component, in particular ethyl acrylate, butyl acrylate or methylmethacrylate and styrene.

The graft modifies the properties of the basic polymer in the desired manner, for example the hydrophilic character is reduced. The grafted monomers are preferably but not necessarily hydrophobic. The presence of reactive groups in the monomers, i.e. groups which are still available after polymerisation, may be advantageous if further chemical modification is envisaged after polymerisation. Thus, for example, a graft polymer on which N-methylol-(meth)acrylamide has been grafted may subsequently be cross-linked by treatment with acid.

Preparation of the graft polymers may be carried out, for example, by polymerising the monomers which contain a double bond, capable of radical polymerisation with the aid of radical forming activators as described in German Offenlegungsschrift No. 2,130,028 in the presence of the hydrophilic, linear basic polymer.

Suitable (poly)alkylene glycole-polycarbonates are linear or branched polycarbonates of aliphatic polyols and/or diols such as hexandiol, butandiol, pentandiol preferably linear or branched polycarbonates of polyalkylene glycols such as polyethylene glycol, polypropylene glycol or polybutylene glycol or mixed polymers thereof particularly of such polyalkylene glycols having a degree of polymerisation of from 2 to 8. Most useful are the polycarbonates di-, tri- or -tetraethylene glycol.

Such polycarbonates can be prepared according to known methods for example by reacting the polyalkylene glycols with diphenyl carbonate.

The graft polymerisation of the monomers in the presence of the (poly)alkyleneglycol polycarbonates having a molecular weight exceeding 500 and preferably of between 700 and 7000 may be performed in substance in solution or as dispersion or emulsion polymerisation.

EXAMPLE 1

This example, in the same way as Example 2, shows that, when the monomer quantity used is still small as compared with the polycarbonate quantity, a great portion of the polycarbonate can be included in the grafting reaction or that graft polymers are formed at all.

Stir 100 parts of diethylene glycol polycarbonate (m. w. approx. 2000) together with 50 parts of vinyl acetate and 0.5 parts of benzoyl peroxide for 10 hours at 80° C and for 3 hours at 95° C, dispelling the air by nitrogen. The result is a clear polymer mass with a residual monomer content of 0.3% as determined by gas chromatography.

EXAMPLE 2

Same as Example 1, except that triethylene glycol polycarbonate (m.w. approx. 2500) is substituted for diethylene glycol polycarbonate. The result is a clear polymer mass with a residual monomer content of 0.2% as determined by gas chromatography.

The products obtained according to Examples 1 and 2 were subjected to a fractionation in acetone solution by precipitation with methanol and subsequently with ligroin. (Whereas polyvinyl acetate is soluble in methanol, di- and triethylene glycol polycarbonate were only soluble in methanol in proportions of 0.4% and 2.7% by weight, respectively.) It follows from the polyvinyl acetate contents determined in the individual fractions by acetyl determination or IR spectrometry that approx. 70% by weight of the polycarbonate used in Example 1 and approx. 80% by weight of that used in Example 2 has been included in the grafting reaction.

EXAMPLE 3

Same procedure as in Example 2, except that the vinyl acetate and catalyst quantities are doubled. The analytical investigation carried out by analogy with Examples 1 and 2 shows that approx. 100% of the polycarbonate used has been included in the grafting process.

EXAMPLE 4

It is shown that not only methods of mass polymerization but also solution polymerization are suitable for producing the graft polymers:

Stir 100 parts of triethylene glycol polycarbonate together with 1 part of azodiisobutyronitrile and 200 parts of t-butanol under $N_2$ for 10 hours at 75° C. Work-up the obtained polymer solution by removal of the solvent under reduced pressure to form a clear polymer mass; its analytical testing by analogy with Examples 1 and 2 shows that approx. 90% by weight of the polycarbonate used has been included in the grafting reaction.

Vinyl acetate can be replaced with vinyl propionate or vinyl versate. The polymer masses thus accessible are suitable plasticizers for polyvinyl acetate.

EXAMPLE 5

Dissolve 70 parts of vinyl chloride, 0.5 parts of lauroyl peroxide and 30 parts of diethylene glycol polyacetal (m.w. approx. 3000) in one another and add to a solution of 0.2 parts of methyl cellulose in 200 parts water in an autoclave. Purge with $N_2$ and polymerize at 60° C until pressure drops. Filter off, and dry, the resulting polymer suspension. From the approx. 95 parts of polymer obtained, only 1.5 parts of the polycarbonate can be extracted with chloroform, which shows that the major portion of the polycarbonate has been included in the grafting reaction. The vinyl chloride graft polymer thus obtained is suitable for the production of particularly soft coatings.

By analogous procedure, acrylonitrile can be used in place of soft coatings.

EXAMPLE 6

Add 30 parts of triethylene glycol polycarbonate (m.w. approx. 3000) and 70 parts of ethyl acrylate to a solution of 3 parts slack wax sulphonate (average chain length of 14–15 C atoms) in 200 parts of water. Then dispel the air by $N_2$ and add 1 part of potassium persulphate and 0.3 parts of sodium pyrosulfite. Carry out the emulsion polymerization by stirring and heating to approx. 45° C for 15 hours; this will yield a stable graft polymer latex. Films produced from this latex have higher tack than pure polyether acrylate and are suitable for the formulation of pressure-sensitive adhesives.

It is also possible to replace triethylene glycol polycarbonate with tetraethylene polycarbonate as well as ethyl acrylate with butyl acrylate, methyl methacrylate or mixtures of ethyl acrylate with other monomers like styrene, acrylic acid, (meth-) acrylamide or its methylol compounds; such replacement leads to latices that can be crosslinked.

Grafting may be carried out solvent-free, in solution or as a dispersion polymerisation or emulsion polymerisation.

Suitable radical-forming activators, apart from high energy radiation, are particularly activators or redox systems which are water-soluble or soluble in the monomers, e.g. azo compounds such as azodiisobutyronitrile or peroxidic compounds such as dibenzoyl peroxide, dilauroyl peroxide, hydroperoxides, cumene hydroperoxide, percarbonates, peresters or redox systems such as potassium persulphate/sodium pyrosulphite or potassium persulphate/triethanolamine. These activators are used in quantities of 0.01 to 10% by weight, preferably 0.1 to 3% by weight, based on the monomers put into the reaction.

The proportion of graft basis i.e. for example of the (poly)alkylene glycol carbonate, to the monomers may be varied as desired but the total quantity of both components preferably contains 1 to 90% by weight and most preferably 5 to 70% by weight of the graft basis, but it should be taken into account that the more the (poly)alkylene glycol polycarbonate takes part in the grafting reaction, the higher should be the proportion of monomer.

The monosheet material according to the invention is suitably prepared by first preparing two partial layer units separately from each other by applying some of the required layers to a first support layer and the other layers to a second support layer in the appropriate sequence according to their function. The two partial layer units are then joined together with their active surfaces facing each other, using the graft polymer according to the invention, to form an integral monosheet material. To laminate the two parts of the monosheet material, a layer of the graft polymer according to the invention may be formed on one or both of the two surfaces of the partial units facing each other, and the two parts are then pressed together. The polymer layer may be produced by any of the usual coating methods, for example the surface of the partial layer unit may be brought into contact with an aqueous solution of a graft polymer by immersion. The solvent then presumably enters the lower layers of the binder in the partial layer unit while the graft polymer is deposited mainly on the surface since it is less capable of diffusion. Another method consists of spraying a solution of the graft polymer on the surface. Alternatively, the layer of the graft polymer may be formed at the same time that the two partial layer units are brought into contact with each other. In that case, the two partial units are placed together along one of their edges with their active surfaces facing each other, and a small quantity of a solution of the graft polymer is introduced into the angular space formed between the two partial units, where it forms a meniscus. The two partial units are then passed through a pair of spring tensioned squeezing rollers with the joined edges leading, so that the graft polymer liquid is uniformly distributed between the two surfaces and provides the desired temporary bond.

The layer of graft polymer which effects the temporary bond between the two layer units to be laminated may have a thickness which varies according to method of preparation. It is however desired to keep this layer as thin as possible. Useful bonding layers therefore may have a thickness between 0.5 and 3.0 $\mu$. As the graft polymer is more or less hydrophilic the most preferred solvent is water. However also other solvents are useful for producing the bonding layer, for example lower aliphatic alcohols which are miscible with water, such as ethanol or isopropanol, or other solvents which are only slightly miscible with water such as benzyl alcohol or methylethylketone.

As already mentioned above, the layer of graft polymer which produced the temporary bond may in principle be arranged in any position within the sequence of layers of the monosheet material. According to the invention, it is arranged in the position where the processing liquid is to be introduced, for example between the image receiving layer and the light-sensitive layer unit or between the latter and the second dimensionally stable support layer. However, it may be arranged in any other position, for example between two layers of the light-sensitive layer unit. If two or more processing liquids are provided for processing the monosheet material and these two materials are to be used in different positions within the structure of the monosheet material and are therefore provided in separate containers, several graft polymer layers may of course also be provided for example between the image receiving layer and light-sensitive layer unit so that a processing liquid which contains a light-reflecting pigment or is capable of producing a light-reflecting pigment layer can be distributed between these two surfaces, and between the light-sensitive layer unit and the second support layer so that a developer liquid, possibly one containing a clouding agent, may be distributed between these two surfaces.

The transparent support layer used for the monosheet material according to the invention may be any of the transparent substrates conventionally used in photographic practice, for example films of cellulose esters, polyethylene terephthalate, polycarbonate or other film forming polymers. Preferably, both substrates are transparent, but according to the invention one of the substrates, namely the one that is closer to the light-sensitive layer unit than to the image receiving layer in the monosheet material, may be opaque. Any flexible, opaque substrates may be used for this purpose, including paper, polyalkylene foils which may, if desired, be coated on one or both sides, pigmented polyethylene terephthalate or pigmented cellulose acetate.

The image receiving layer substantially consists of a binder containing the dye mordant for fixing the diffusible dyes.

The mordants for acid dyes used are preferably long chain quaternary ammonium or phosphonium compounds or ternary sulphonium compounds e.g. those described in U.S. Pat. Spec. Nos. 3,271,147 and 3,271,148. Certain metal salts and their hydroxides which form sparingly soluble compounds with the acid dyes may also be used. The dye mordants are dispersed in one of the usual hydrophilic binders in the image receiving layer, for example in gelatine, polyvinyl pyrrolidone or partially or completely hydrolysed cellulose esters or the like. Some binders may, of course, function as mordants for example copolymers or polymer mixtures of vinyl alcohol and N-vinylpyrrolidone as described, for example in German Auslegeschrift No. 1,130,284, or binders which consist of polymers of quaternary bases which contain nitrogen, for example polymers of N-methyl-2-vinylpyridine as described, for example, in U.S. Pat. No. 2,484,430. Other useful mordanting binders include, for example, the quanylhydrazone derivatives of alkyl vinyl ketone polymers as described e.g. in U.S. Pat. No. 2,882,156 or guanylhydrazone derivatives of acylstyrene polymers as described e.g. in German Offenlegungsschrift No. 1,009,498. As a general rule, however, other binders, e.g. gelatine, would be added to the last mentioned mordanting binders.

The light reflecting layer arranged between the light-sensitive layer unit and the image receiving layer is permeable to aqueous alkaline treatment solutions and therefore to diffusible dyes. It has two main functions. First, it serves to mask the image silver remaining in the original light sensitive layer unit after development as well as the colour producing compounds which are left behind as a colour negative so that when the material is viewed through the transparent support layer of the light-sensitive part, only the positive colour transfer image can be seen. Second, it forms a lightproof seal which prevents the light-sensitive layer unit to become exposed from the side of the image receiving layer. This is particularly important if the exposed monosheet material is brought into contact with the alkaline processing substrate while it is still inside the camera and then pulled out of the camera and developed outside.

The light reflecting layer therefore consists primarily of a layer of binder which contains white pigments. Any white pigments may be used for this purpose provided that they have sufficient covering power without being applied in unduly thick layers. Suitable examples include barium sulphate, oxides, of zinc, titanium, silicon, aluminium and zirconium, barium stearate and kaolin. Titanium dioxide is the white pigment preferably used. Gelatine, for example, is a suitable binder. The pigment layer may contain up to 90% by weight of white pigment, based on the total mass. The particle size of the pigments used is comparatively uncritical provided that it does not substantially exceed 0.5 $\mu$. The thickness of the white pigment layer may be varied according to the desired whiteness of the background. Thicknesses of from 5 to 15 $\mu$ are preferably used. If desired, a black pigment layer may also be provided on the side facing the light-sensitive layer unit. Carbon black is a suitable pigment for this purpose.

Instead of the light reflecting layer, the monosheet material according to the present invention may also contain means for producing such a light reflecting layer between the light sensitive layer unit and the image receptor layer, for example in the form of a container arranged at the side of the monosheet material to hold a processing liquid which contains a clouding agent (pigment) and which when subjected to mechanical force releases its contents between the said layers to form a pigment layer.

One essential component of the photographic monosheet material according to the present invention is the light-sensitive element, which in the case of a monochrome transfer process contains a light-sensitive silver halide emulsion layer and, associated with it, a colour producing compound which gives rise to an imagewise distribution of diffusible dyes. The colour producing compound may be situated in a layer adjacent to the silver halide emulsion layer or in the silver halide emulsion layer itself. In the latter case, the colour of the image dye is preferably selected so that the predominant absorption range of the colour producing compound does not correspond with the predominant sensitivity range of the silver halide emulsion layer. For producing multicoloured transfer images in colours true to life, however, the light-sensitive element contains three such arrangements of colour producing compound and light sensitive silver halide emulsion layer, and as a rule the absorption range of the diffusible dye obtained from the colour producing compound substantially corresponds with the range of spectral sensitivity of the associated silver halide emulsion layer. If the colour of the diffusible dye corresponds to the colour of the colour producing compound, however, it is necessary for the purpose of obtaining the highest possible sensitivity to arrange the colour producing compound in a separate layer of binder behind the silver halide emulsion layer (viewed in the direction of the incident light used for exposure).

The developer oxidation products produced by development of the silver halide emulsion must, of course, be restricted in their action to the associated colour producing compound. Separating layers are therefore provided in the light-sensitive element which effectively prevent diffusion of the developer oxidation products into other, non-associated layers. These separating layers may, for example, contain suitable substances which react with the developer oxidation products, for example non-diffusible hydroquinone derivatives, or if the developer is a colour developer substance they may contain non-diffusible colour couplers. In a preferred embodiment of the invention, therefore, the light-sensitive element has the following structure (viewed in the direction of the incident light used for exposure):

Blue sensitive silver halide emulsion layer
Layer containing a compound which gives rise to a diffusible yellow dye,
Separating layer,
Green sensitized silver halide emulsion layer,
Layer containing a compound which gives rise to a diffusible magenta dye,
Separating layer,
Red sensitized silver halide emulsion layer,
Layer containing a compound which gives rise to a diffusible cyan dye.

The silver halide emulsion layers may, of course, be arranged in some other sequence, but the associated layers containing the colour producing compounds must then also be changed accordingly so that the appropriate layers remain in association with each other.

By "association" and "associated" is meant that the silver halide emulsion and the colour producing compound are associated with each other or arranged in relation to each other in such a manner that they are capable of interaction so that there can be imagewise correspondence between the silver image produced and the imagewise distribution of the diffusible dye liberated. The associated colour producing compound is preferably incorporated in the silver halide emulsion itself or in a layer adjacent to the silver halide emulsion layer, and this adjacent layer is preferably situated behind the silver halide emulsion layer (viewed in the direction of the incident light used for exposure).

The usual silver halide emulsions may be used for the present invention. They may contain silver chloride, silver bromide or mixtures thereof, if desired with a small silver iodide content of up to 10 mols percent.

The binder for the photographic layers used is preferably gelatine although this may be partly or completely replaced by other natural or synthetic binders. Suitable natural binders include e.g. alginic acid and its derivatives such as salts, esters or amides, cellulose derivatives such as carboxymethylcellulose, alkylcellulose and such as hydroxyethylcellulose, starch or its derivatives such as ethers or esters or carrageenates. Suitable synthetic binders include polyvinyl alcohol, partially saponified polyvinyl acetate, polyvinylpyrrolidone and the like.

The emulsions may also be chemically sensitized, for example by the addition of sulphur compounds such as allyl isothiocyanate, allylthiourea, sodium thiosulphate and the like at the chemical ripening stage. Reducing agents may also be used as chemical sensitizers, for example the tin compounds described in Belgian Patent No. 493,464 and No. 568,687; polyamides such as diethylene triamine or aminomethanesulphinic acid derivatives may also be used, e.g., according to Belgian Patent No. 547,323.

Noble metals such as gold, platinum, palladium, iridium, ruthenium or rhodium and compounds of these metals are also suitable as chemical sensitizers. This method of chemical sensitization has been described in the article by R. Koslowsky, Z. Wiss. Phot, 46, 65–72 (1951).

The emulsions may also be sensitized with polyalkylene oxide derivatives, e.g. with a polyethylene oxide which has a molecular weight of between 1000 and 20,000 or with condensation products of alkylene oxides and aliphatic alcohols, glycols or cyclic dehydration products of hexitols with alkylsubstituted phenols, aliphatic diamines and amides. The condensation products have a molecular weight of at least 700 and preferably more than 1000. These sensitizers may, of course, be combined to produce special effects, as described in Belgian Patent Specification No. 537,278 and British Patent Specification No. 727,982.

The emulsions may also be spectrally sensitized, for example by the usual monomethine or polymethine dyes such as acid or basic cyanines, hemicyanines, streptocyanines, merocyanines, oxonols, hemioxonols, styryl dyes or the like or trinuclear or higher nuclear methine dyes, for example, rhodacyanines or neocyanines. Sensitizers of this kind have been described, for example, in the work by F. M. Hamer "The Cyanine Dyes and Related Compounds" (1964), Interscience Publishers John Wiley and Sons. The emulsions may also be supersensitized in known manner by using suitable combinations of dyes of the kind mentioned above.

The emulsions may contain the usual stabilizers, e.g. homopolar or salt type compounds of mercury which contain aromatic or heterocyclic rings such as mercaptotriazoles or simple mercury salts, sulphonium mercury double salts and other mercury compounds. Azaindenes are also suitable stabilizers, particularly tetra- or penta-azaindenes and especially those which are substituted with hydroxyl or amino groups. Compounds of this kind have been described in the article by Birr, Z. Wiss. Phot. 47, 2 – 27 (1952). Other suitable stabilizers include heterocyclic mercapto compounds e.g., phenylmercaptotetrazole, quaternary benzothiazole derivatives, benzotriazole and the like.

The emulsions may be hardened in the usual manner, for example with formaldehyde or halogenated aldehydes which contain a carboxyl group such as mucochloric acid, diketones, methanesulphonic acid esters, dialdehydes and the like.

The emulsions may be conventional negative emulsions or direct positive emulsions depending on the nature of the required image (positive or negative) and on the nature of the selected colour producing compound.

The direct positive silver halide emulsions used may in principle be any which are converted into a positive silver image by simple development and result in imagewise distribution of developer oxidation products corresponding to this silver image. They include, for example, those silver halide emulsions in which a developable fog which has been produced by exposure to light or by chemical treatment is destroyed imagewise on exposure to light under certain conditions. The fog is preserved in the unexposed areas so that when the emulsion is subsequently developed, a direct positive silver image is obtained and, corresponding to it, an imagewise distribution of diffusible dye if a colour producing compound is associated with the direct positive silver halide emulsion.

Another group of direct positive silver halide emulsions which are preferred according to the present invention includes the so-called unfogged direct positive silver halide emulsions in which the light-sensitivity is situated predominantly in the interior of the silver halide grains. Development of such unfogged direct positive silver halide emulsions, however, is carried out under fogging conditions so that a fog produced in the unexposed areas and a positive silver image is obtained on development. The unfogged direct positive silver halide emulsions are characterised by the fact that when exposed samples are developed with a typical surface developer of the following composition:

| | |
|---|---|
| p-Hydroxyphenylglycine | 10 g |
| Sodium carbonate (crystallised) | 100 g |
| made up with water to | 1000 ml |

they preferably do not give rise to a silver image or only one of very low density, whereas a silver image with sufficient density is obtained when development is carried out with an internal nuclear developer of the following composition:

| | |
|---|---|
| Hydroquinone | 15 g |
| Monomethyl-p-aminophenolsulphate | 15 g |
| Sodium sulphite (anhydrous) | 50 g |
| Potassium bromide | 10 g |
| Sodium hydroxide | 25 g |
| Sodium thiosulphate (crystallised) | 20 g |
| made up with water to | 1000 ml. |

Selective fogging of unfogged direct positive emulsions which have been exposed imagewise may be carried out by treatment with a fogging agent before or during development. Reducing agents such as hydrazine or substituted hydrazines are suitable fogging agents as is described for example, in U.S. Pat. No. 3,227,552.

Unfogged direct positive emulsions include, for example, those which have defects in the interior of the silver halide grains (U.S. Pat. No. 2,592,250) or silver halide emulsions which have a layered grain structure (German Offenlegungsschrift No. 2,308,239).

The colour producing compound used in the monosheet material according to the invention may be any compound from which an imagewise distribution of diffusible dyes or dye precursors can be obtained on development of the silver halide. They may be compounds which are diffusible during the development in an alkaline medium and are immobilised imagewise in accordance with the silver image formed. Such compounds are suitable when used in combination with the usual negative emulsions for producing positive transfer images. They include the so-called dye developers described in German Auslegeschrift No. 1,196,075.

Recently, however, the colour producing compounds which have gained increasing importance for dye diffusion transfer processes are those which are not capable of diffusing in the layers (not even in an alkaline medium) and are therefore referred to as "non-diffusible" in the context of the present application and from which diffusible dyes or dye precursor products are liberated imagewise in correspondence with the silver image when development is carried out.

This type of non-diffusible colour producing compounds includes, for example, the non-diffusible colour couplers described in German Patent No. 1,095,115, which, when development is carried out, react with the oxidation product of a colour developer compound consisting of a primary aromatic amine and as a result liberate a dye in a diffusible form, which dye is either preformed or produced in the colour coupling reaction. The choice of developer compound in that case is, of course, restricted to colour developers.

Reference should also be made in this connection to the non-diffusible colour producing compounds described in German Offenlegungsschrift No. 1,930,215, in which a preformed dye residue which has a latent capacity for diffusion is linked to a residue which confers diffusion resistance through a hydrazone group which can be split off. These compounds should not be referred to as colour couplers and it has also been proved that the choice of developer compounds which are required for liberating the diffusible dye residue is by no means restricted to the usual colour developers but may very well include black-and-white developers, e.g. pyrocatechols.

Non-diffusible coloured compounds which contain a special group have also been described in German Offenlegungsschrift No. 1,772,929. They undergo an oxidative ring closure reaction on development, thereby liberating a preformed dye residue in a diffusible form. The compounds described in the said document may be divided into two groups. The compounds of one group require a conventional colour developer compound for development; they couple with the oxidation product of this developer compound and, in a subsequent ring closure reaction, they liberate the preformed dye residue in a diffusible form. The compounds of the other group are silver halide developers and are therefore capable of undergoing the aforesaid ring closure reaction in the oxidized form to liberate the diffusible dyes even in the absence of other developer compounds.

Lastly, the non-diffusible colour producing compounds according to German Offenlegungsschrift No. 2,242,762 remain to be mentioned in this connection. These compounds are sulphonamidophenols and sulphonamidoanilines which are split under the action of the developer alkali after the oxidation reaction of development, and thus liberate diffusible dyes.

The above mentioned colour producing compounds all without exception function negatively, that is to say if a conventional negative silver halide emulsion is used, the imagewise distribution of the liberated diffusible dye corresponds to the negative silver image produced by development. To obtain positive dye images, it is therefore necessary to use positive silver halide emulsions or to carry out a suitable reversal process.

One such process is the silver salt diffusion process. Photographic reversal by the silver salt diffusion process to produce positive coloured images using conventional colour couplers has been described, for example, in U.S. Pat. No. 2,763,800. A light-sensitive element suitable for the dye diffusion transfer process is obtained by replacing the colour couplers by the colour producing compounds mentioned above. One such light-sensitive element, for example, comprises at least one combination of a light-sensitive silver halide emulsion layer and an associated layer of binder containing development nuclei for the physical development of a colour producing compound.

The development process chemically develops the exposed portions of the light-sensitive silver halide emulsion layer while a silver halide solvent transfers the unexposed portions into the associated layer of binder which contains development nuclei, where they are developed physically. If physical development is carried out with a developer which in its oxidized form is capable of liberating a diffusible dye as a result of a reaction with the colour producing compound present in this layer, then an imagewise distribution of diffusible dyes is obtained, which may be transferred to an image receiving layer to form a positive colour image there.

If reversal is carried out using compounds which split off development inhibitors imagewise, then the light-sensitive element consists of at least one layer combination of a light-sensitive silver halide emulsion layer and a second emulsion layer which is capable of development without exposure and which contains the colour producing compound. The light sensitive silver halide emulsion layer is developed, for example with colour developers, in the presence of certain compounds which split off development inhibiting substances in the reaction with oxidized colour developer. The development inhibiting substances which have been liberated imagewise in the light sensitive layer diffuse into the adjacent emulsion layer which is developable without exposure, where they bring about imagewise inhibition of development. The uninhibited (positive) portions of the emulsion layer which is capable of development without exposure are developed by the remaining developer, the oxidation products of which then react with the non-diffusible colour producing compounds according to the invention to liberate diffusible dyes which are transferred imagewise to the image receptor element. Suitable compounds which split off development inhibiting substances in the reaction with colour developer oxidation products include, for example, the known DIR couplers (DIR = development inhibitor releasing) which are colour couplers in which an inhibitor group which can be split off is situated in the coupling position. DIR couplers of this kind have been described, for example, in U.S. Pat. No. 3,227,554.

Another group of compounds which react with colour developer oxidation products to split off development inhibiting substances has been described in U.S. Pat. No. 3,632,345. These compounds are not colour couplers and no dyes are formed when the development inhibiting substances are released. According to German Patent Specification No. 1,229,389, such a process may also be carried out using suitable substituted, non-diffusible hydroquinone compounds which when reacted with developer oxidation product are oxidized to the corresponding quinones and split off development inhibiting mercaptans.

To process the monosheet material, a liquid or pasty processing substance is pressed between a first and second layer of the monosheet material between which the layer containing the graft polymer is situated according to the invention. The monosheet material is thereby adjusted to a relatively high pH (about 11 to 14) which releases development and imagewise diffusion of dye. It has been found that at this high pH the dyes and therefore the images obtained are not particularly stable. It is therefore necessary to adjust the material to an almost neutral or slightly acid pH after development. This can be achieved in known manner by providing the material with an additional acid polyer layer which becomes accessible to the alkaline processing substance only gradually in the course of development. By acid polymer layer is meant a layer of binder which contains polymeric compounds with acid groups, preferably sulpho or carboxyl groups. These acid groups react with the cations of the alkaline processng mass to form salts and thereby reduce the pH of the substance. The polymer compounds and hence the acid groups may, of course, be incorporated in a diffusion-fast from in the said layer. The acid polymers are frequently derivatives of cellulose or derivatives of polyvinyl compounds although other polymer compounds may also be used. The following are examples of suitable acid polymers: Cellulose derivatives which contain a free carboxyl group, e.g. cellulose dicarboxylic acid semiesters containing a free carboxyl group, such as cellulose acetate hydrogen phthalate, cellulose acetate hydrogen glutarate, ethyl cellulose acetate hydrogen succinate, cellulose acetate hydrogen succinate hydrogen phthalate, ethers and esters of cellulose modified with other dicarboxylic acid anhydrides or with sulphonic acid anhydrides, for example with o-sulphobenzoic acid anhydride, carboxymethyl cellulose, polystyrene sulphonic acid, polyvinyl hydrogen phthalate, polyvinyl acetate hydrogen phthalate, polyacrylic acid, acetals of polyvinyl alcohol with aldehydes which are substituted with carboxyl or sulpho groups, such as o-, m- or p-benzaldehyde sulphonic acid or banzaldehyde carboxylic acid, partially esterified copolymers of ethylene and maleic acid anhydride, partially esterified copolymers of methyl vinyl ether and maleic acid anhydride, and the like.

The acid polymer layer must contain sufficient acid groups to reduce the pH of the processing substance from its initial value of from 11 to 14 to almost neutral or slightly acid (pH 5 to 8).

The time delay in the lowering of the pH value is achieved in known manner by coating the acid polymer layer with a so-called retarding layer. This is an alkali permeable layer preferably consisting of a polymer which is inert towards alkalies, for example polyvinyl alcohol or a partially acetalised polyvinyl alcohol. The time delay in the fall in pH can be adjusted as desired by suitable choice of the thickness and composition of this retarding layer.

Neutralisation systems, that is to say combinations of an acid polymer layer with a retarding layer, have been described, for example, in German Patent Specification No. 1,285,310. These layer combinations may be situated in the monosheet material, suitably between the combination of layers formed by the image receiving layer, light reflecting pigment layer and light sensitive layer unit on the one hand and one of the two support layers on the other. Care should be taken to ensure that the retarding layer is situated not only between the above mentioned layer combination and acid polymer layer but also between the said acid polymer layer and the position at which the alkaline processing substance is introduced.

EXAMPLE 1

Two film strips of cellulose triacetate provided with a thin hydrophilic gelatine bonding layer were each coated with a gelatine layer about 10 $\mu$ in thickness and slightly hardened with formalin. The foils were then laminated together in pairs with their coated surfaces in contact by dipping one of the layers into a 10% aqueous solution of bonding layer polymer to inpregnate it with this solution and then placing the layers together as a sandwich which was then passed through a spring tensioned pair of squeezing rollers. The strength of the bond obtained when the double strip is dry depends on the composition of the bonding solution used so that the two layers may either be completely inseparable or more or less easily separated again without the gelatine layers being thereby damaged or destroyed. The polymer used as the base was Polywachs 3000 (PW 3000), a polyethylene glycol which has an average molecular weight of 3000. The quantity of vinyl acetate grafted on the polymer is indicated in percent by weight, based on the total quantity of the graft polymer.

The proportions are clearly indicated in the following table:

| Aqueous polymer solution | Strength of bond after drying |
|---|---|
| $H_2O$ | inseparable, firm |
| Polywachs 3000 (PW 3000) | inseparable |
| PW 3000 grafted with | |
| 4% vinyl acetate | difficulty separable |
| 12% vinyl acetate | separable |
| 20% vinyl acetate | readily separable |
| 40% vinyl acetate | too easily separable |
| 80% vinyl acetate | no bond |

EXAMPLE 2

If two cellulose triacetate foils coated with a gelatine layer were laminated as described in Example 1, using the aqueous solutions of the graft polymers indicated below, the various bonds between the two layers obtained were also graduated in their separability, the bonding strengths between the layers decreasing with increasing degree of graft. The bonded layers remained fully transparent.

The following Table shows the graded effect obtained:

| Aqueous polymer solution | Strength of bond after drying |
|---|---|
| $H_2O$ | inseparable |
| PW 3000 grafted with | |
| 2.5% vinyl benzoate | easily separable |
| 10% vinyl benzoate | very easily separable |
| 25% vinyl benzoate | too easily separable |
| 40% vinyl benzoate | no bond obtained |

Similar results were obtained when polywax was grafted with vinyl propionate, and the same graded effect was obtained if one of the gelatine layers was replaced by a layer of polyvinyl alcohol.

EXAMPLE 3

The results obtained in Examples 1 and 2 can easily be transferred to the dissoluble bond of a photograph monosheet material according to the invention. By way of example such a material may have the composition indicated below the quantities indicated representing the quantities applied per $m^2$:

a. Light-sensitive element containing an image receiving layer and reflection layer:

The following layers were coated on to a transparent image receiving layer support:

1. An image receiving layer of 3.8 g of octadecyltrimethylammonium monomethylsulphate and 9.5 g of gelatine;
2. an opaque light reflecting layer which is permeable to alkaline processing liquids and consists of 48.5 g of titanium dioxide and 4.85 g of gelatine;
3. a layer of nuclei containing 1.32 g of compound L which forms a cyan transfer dye (see annexe of formulae), 4.5 mg of silver sulphide nuclei, 0.1 g of carbon black, 0.88 g of developer A (see annexe of formulae) and 2.5 g of gelatine;
4. a red sensitive silver bromide emulsion layer containing 2 g of gelatine 1.1 g of silver, 0.37 g of developer B (see annexe of formulae) of 1.23 g of developer C (see annexe of formulae);
5. a separating layer consisting of 3.9 g of gelatine and 0.18 g of developer C;
6. a nuclear layer containing 0.48 g of compound M which forms a magenta transfer dye (see annexe of formulae), 3.8 mg of silver sulphide muclei, 0.76 g of developer A and 2.1 g of gelatine;
7. a green sensitive gelatine silver bromide emulsion layer containing 2 g of gelatine, 0.7 g of silver, 1.23 g of developer C and 0.37 g of developer B;
8. a separating layer of 3.9 g of gelatine and 0.18 g of developer C;
9. a nuclear layer containing 0.85 g of compound N which forms a yellow transfer dye (see annexe of formulae), 4.2 mg of silver sulphide, 0.85 g of developer A and 2.4 g of gelatine;
10. a blue sensitive gelatine silver bromide emulsion of 2 g of gelatine, 0.9 g of silver, 1.23 g of developer C and 0.37 g of developer B;
11. a layer of 1.2 g of gelatine and 0.12 g of 1-phenyl-3-pyrazolidone.

b. Cover sheet containing neutralisation system

A transparent cellulose triacetate film substrate was covered first with a 20 $\mu$ thick acid polymer layer of the butyl semiester of an ethylene/maleic acid anhydride copolymer (as described in U.S. Pat. No. 3,362,819) which in turn was covered with a retarding layer for diffusible hydroxyl ions, consisting of a terpolymer latex of butyl acrylate/diacetone acrylamide/methacrylic acid/styrene in proportions of 60/30/6/4 and polyacrylamide, the terpolymer latex and polyacrylamide being mixed in proportions 80:1 and the layer having a thickness of about 15 $\mu$: this layer in turn was covered by a thin protective gelatine layer of 3–4 $\mu$.

These two sheets were laminated with a 10% aqueous solution of a graft polymer of 20% vinyl acetate on Polywachs 3000 as described in Example 1 with the exclusion of light. The bond between the layers was just firm enough to maintain contact between the layers until they were exposed inside the camera but when the alkaline processing solution which was slightly thickened with hydroxyethylcellulose was forced between the layers, the bond between them was eliminated without damage to the light-sensitive element.

The processing solution had the following composition:

20 g of NaOH
25 g of Natrosol HHR 250 (highly viscous hydroxyethylcellulose) made up to
1000 ml with water.

A full coloured, sharp image of the original was obtained after treatment with the processing solution for about 3 minutes. The image was visible through the transparent substrate of the light-sensitive element. The bonding layer according to the invention was completely clear and transparent and in no way interfered with the exposure.

Appendix of formulae

A

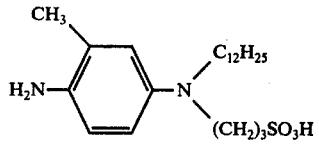

B

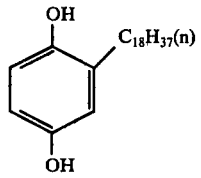

C

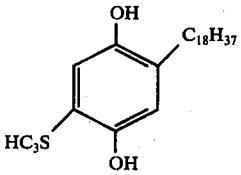

Formula L

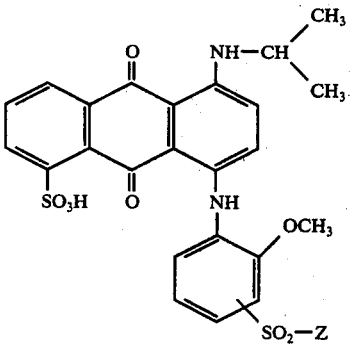

M)

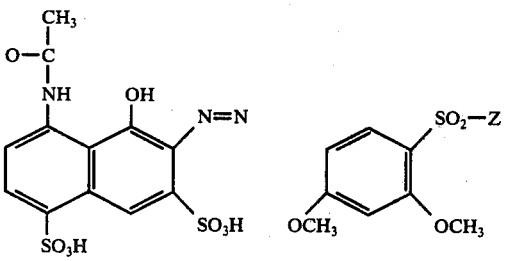

-continued

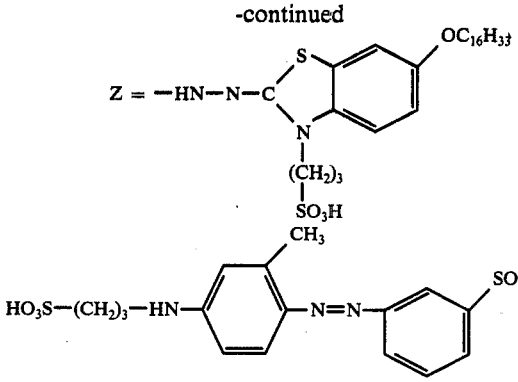

N)

We claim:

1. Photographic monosheet material for the dye diffusion transfer process, containing the following layers in the given sequence between a first and a second dimensionally stable support layer, of which at least the first is transparent:

a. an image receiving layer, b. a light reflecting pigment layer or means for producing such a light reflecting pigment layer and c. a light-sensitive layer unit containing at least one light-sensitive silver halide emulsion layer with which a colour producing compound is associated, and a destructible container containing processing liquid arranged at the side, which container releases its contents between a first and second binder layer of the monosheet material when subjected to mechanical force, a bond existing between the said first and said second binder layer of the monosheet material before and after processing, which bond is temporarily eliminated under the action of the processing liquid, wherein the improvement comprises between said first layer and said second layer there is arranged another layer which consists substantially of a graft polymer obtained by grafting a monomer containing a double bond which is capable of radical polymerisation on a hydrophilic linear basic polymer consisting substantially of one or more of the following recurrent units:

$$(-R_1-O-),\ (-R_2-O-) \text{ and } (-R_3-O-CO-)$$

in which $R_1$, $R_2$ and $R_3$ each represents an alkylene group containing 1 to 8 carbon atoms, and having a molecular weight of between 2000 and 10,000.

2. Photographic monosheet material as claimed in claim 1, wherein the monomer which contains a radically polymerizable double bond and which is grafted on the hydrophilic linear basis polymer is selected from the group consisting of a vinyl ester of an aliphatic or aromatic carboxylic acid, vinyl chloride, acrylonitrile, styrene, acrylic acid, methacrylic acid, and an alkylester or acrylic acid or methacrylic acid.

3. Photographic monosheet material as claimed in claim 1, wherein 1 to 90 % by weight of the graft polymer consists of the basic polymer and the remainder consists of grafted monomer.

* * * * *